United States Patent [19]

Matucheski

[11] 4,150,919

[45] Apr. 24, 1979

[54] RADIATOR COOLING FAN CONSTRUCTION

[75] Inventor: Joseph V. Matucheski, Indianapolis, Ind.

[73] Assignee: Wallace Murray Corporation, New York, N.Y.

[21] Appl. No.: 805,393

[22] Filed: Jun. 10, 1977

[51] Int. Cl.[2] ..... F04D 29/32

[52] U.S. Cl. ..... 416/93 R; 416/169 A; 416/181

[58] Field of Search ..... 416/93 R, 169 A, 181; 417/353, 354

[56] References Cited

U.S. PATENT DOCUMENTS

| | | | |
|---|---|---|---|
| 2,262,695 | 11/1941 | Moeller | 416/93 |
| 2,823,008 | 2/1958 | Grey | 416/181 X |
| 3,303,995 | 2/1967 | Boeckel | 416/93 R |
| 3,385,516 | 5/1968 | Omohundro | 416/93 |
| 3,508,842 | 4/1970 | Lievens | 416/93 |
| 3,819,294 | 6/1974 | Honnold et al. | 416/93 |
| 3,993,415 | 11/1976 | Hauser | 416/93 R |

FOREIGN PATENT DOCUMENTS

| | | | |
|---|---|---|---|
| 941416 | 1/1949 | France | 416/93 |
| 61111 | 5/1948 | Netherlands | 416/181 |

*Primary Examiner*—Everette A. Powell, Jr.
*Attorney, Agent, or Firm*—Thomas J. Greer, Jr.

[57] ABSTRACT

A fan construction of the type having a hoop configured hub provided with fan blades. The hub has apertures adjacent the blade roots. A viscous drive carries the hub. Rotation of the fan causes a pressure differential between the two ends of each hub aperture thus forcing an airflow radially outward to assist in cooling the viscous drive.

2 Claims, 3 Drawing Figures

RADIATOR COOLING FAN CONSTRUCTION

This invention relates to a fan construction of the type displaying particular utility for the cooling system of an internal combustion engine. Modern fan constructions often employ a viscous drive which rotationally couples the engine to the radiator cooling fan. The drive is temperature controlled so that the cooling requirements of the engine govern the degree of coupling between the engine and the fan. In this manner the energy abstracted from the engine by the fan is more nearly matched to the cooling requirements of the engine and thereby greater economy in fuel consumption is made possible. Viscous drive couplings however often require cooling in order to preserve the integrity of their shear liquid and other rotating mechanical parts. For this reason, many viscous drives are provided with cooling fins to assist in the dissipation of heat generated in the shear liquid. According to the practice of this invention such coupling arrangements are improved by means of a fan construction which causes a current of air to pass over the cooling fins of a viscous or other type fan drive, all for the purpose of increasing the heat transfer rate from the shear liquid to the ambient conditions.

IN THE DRAWINGS

Figure 1:
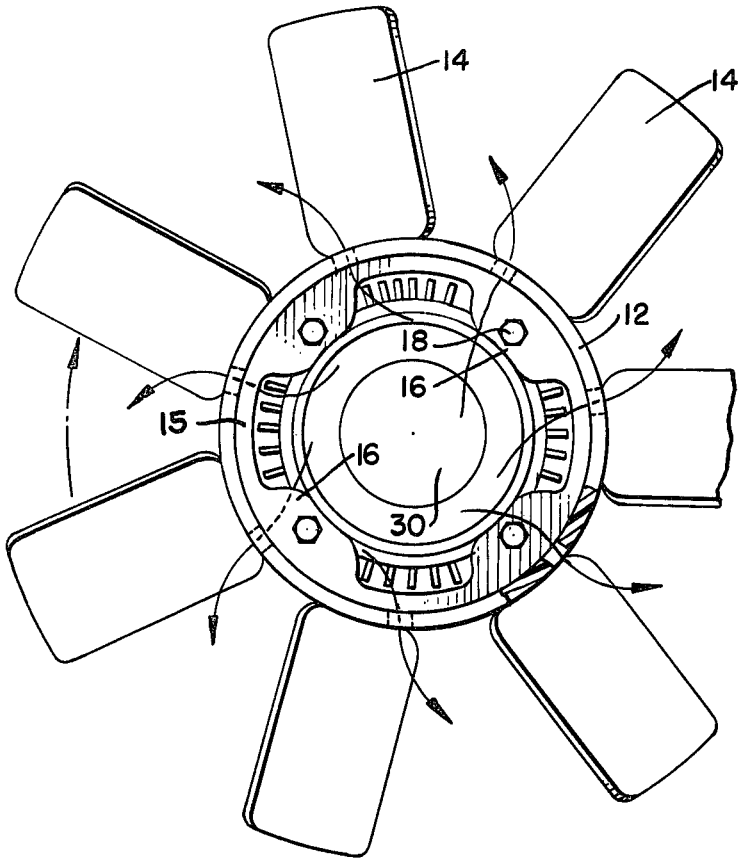
FIG. 1 is a plan view showing the fan construction of this invention in combination with a portion of a viscous drive.

Referring now to the drawings, the numeral 12 denotes a hub of hoop type construction which carries a plurality of fan blades 14. In one embodiment of the invention the hub 12 and fan blades 14 are integral and are fashioned of plastic. The numeral 15 denotes a flat, annular sheet metal coupling member attached to the hub 12 or to an integral part of it, the sheet coupling 15 carrying a plurality of radially inward extending ears 16, each ear carrying an aperture through which threaded fasteners 18 may be used to secure a portion of a viscous drive 30 to the hub. The numeral 32 indicates any one of a plurality of cooling fins integral with the casing of the viscous drive. The numeral 34 indicates a shaft from the drive 30 and carrying a connector 36 for attachment to a rotary part of an internal combustion engine. The specific type of viscous drive coupling 30 employed is not material for the practice of the invention.

Figure 2:
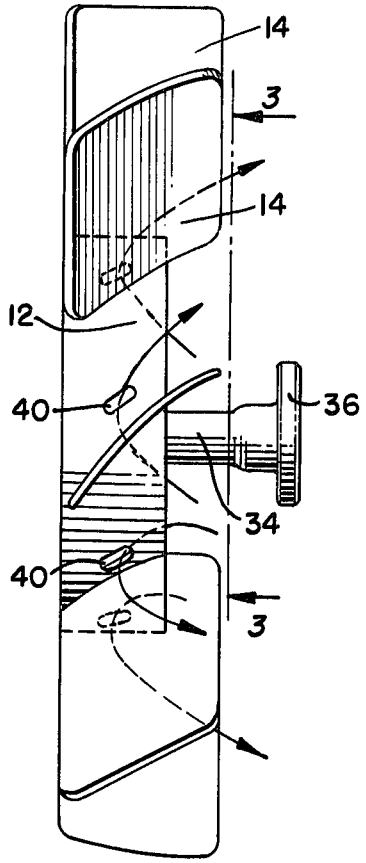
FIG. 2 is an elevational view of FIG. 1.

The numeral 40 denotes any one of a plurality of apertures which extend from the interior to the exterior of the hub 12. Each aperture is associated with a particular fan blade 14 and, in the embodiment shown, each aperture is closer to one of the blades, termed its associated blade, than to any other blade. The practice of this invention dictates that each aperture 40 be located on the suction side of its associated blade. During rotation of the fan the suction side of any blade is at a lower pressure than the forward side of the blade. Apertures 40 are positioned in the hub 12 such that they are axially beyond a portion of the viscous drive 30. Thus, the viscous drive coupling within the hub does not block the passage of air through the apertures the hub 12 may also be considered as an axially extending and circumferentially continuous rim. It will be observed that each aperture 40 is positioned (see FIG. 2) axially behind the leading edge of its associated fan blade 14. The leading edge of each blade 14, as viewed at FIG. 2, is the leftmost portion. It will further be observed that each aperture 40 extends radially through the rim or hoop 12.

Figure 3:
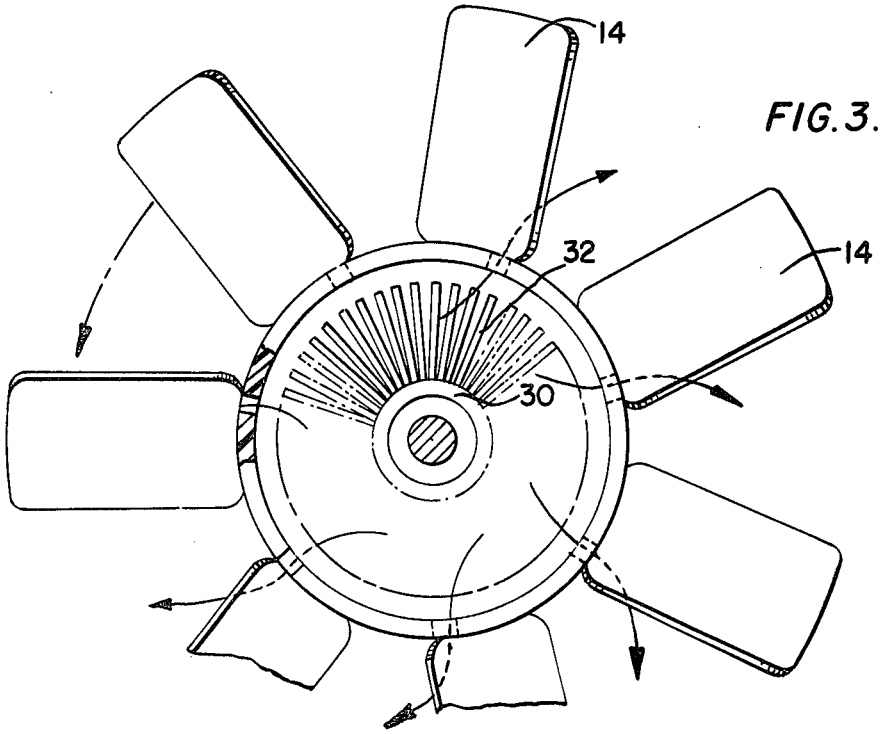
FIG. 3 is a view taken along section 3—3 of FIG. 2.

The mode of operation of the assembly is as follows. During rotation of the fan, assuming clockwise direction as indicated at FIG. 1, the radially outermost portion of each aperture 40 will experience a lower pressure than that which exists at its radially innermost portion. This is because the fan blades move the air which is near the outer hub surface, but do not move the air which is near the inner hub surface. By the application of a well known principle of Bernoulli, it follows that the air pressure adjacent to the root portion of each fan blade 14 is less than the pressure inside of the hub 12 adjacent each aperture. The resultant pressure differential causes an air flow indicated by the curved arrows at FIGS. 1 and 3, namely, air passes radially outward through the apertures 40. This in turn results in a radially outward flow of air over cooling fins 32 to thereby increase the heat transfer rate from the shear liquid in coupling 30 to ambient.

From the above description the reader will observe that the invention is not dependent upon the fan material, i.e., is not dependent upon the plastic material of construction of the hub or the blades. Further, the blades need not be integral with the hub. The invention clearly admits of use in any type of drive, other than a viscous or shear coupling drive, which requires cooling or which would be improved by a cooling flow of air over at least a portion of its surface. It will further be observed that the invention may be employed in a viscous type coupling or oher type coupling wherein only a portion of the coupling is mounted axially within the hub 12.

What is claimed is:

1. A fan construction of the type having a hoop configured hub defined by an axially extending and circumferentially continuous rim, the rim carrying a plurality of radially extending fan blades which extend radially outwardly from its outer surface and are mounted thereon, the improvement comprising, an aperture extending radially through the rim and located adjacent each fan blade and axially behind the leading edge of the fan blade, each aperture located on the suction side of its associated blade, whereby rotation of the fan causes ambient air to pass radially through the rim apertures, the said apertures and the said radially outwardly extending fan blades acting during rotation of the fan to define the sole means for causing radial air movement through said hub apertures.

2. The fan construction of claim 1 including a fan drive at least a portion of which is inside of the hub, the fan drive carrying and rotating the hub, whereby upon rotation of the fan ambient air passing radially outward through the hub apertures contacts at least a portion of the fan drive to thereby assist in transferring heat away from the fan drive by convection.

* * * * *